United States Patent [19]

Patten

[11] 4,088,006

[45] May 9, 1978

[54] AUTOMOTIVE VEHICLE BODY AND FRAME STRAIGHTENING APPARATUS

[76] Inventor: Edgar W. Patten, 1477 Lake Rd., Hamlin, N.Y. 14464

[21] Appl. No.: 718,025

[22] Filed: Aug. 26, 1976

[51] Int. Cl.[2] ..... B21D 1/14

[52] U.S. Cl. ..... 72/457; 72/705

[58] Field of Search ..... 72/705, 461, 457; 248/500, 503; 105/473, 475, 482

[56] References Cited

U.S. PATENT DOCUMENTS

| | | | |
|---|---|---|---|
| 3,095,181 | 6/1963 | Dromboski | 72/705 X |
| 3,269,169 | 8/1966 | Latuff et al. | 72/705 X |
| 3,583,203 | 5/1969 | Williams et al. | 72/705 X |
| 3,590,623 | 7/1971 | Hunnicutt | 72/705 X |
| 3,796,084 | 3/1974 | Jarman | 72/705 X |
| 3,888,100 | 6/1975 | Chisum | 72/705 X |
| 3,921,433 | 11/1975 | Whitney | 72/705 X |

FOREIGN PATENT DOCUMENTS

| | | | |
|---|---|---|---|
| 1,373,287 | 11/1974 | United Kingdom | 72/705 |

*Primary Examiner*—C.W. Lanham
*Assistant Examiner*—D. M. Gurley
*Attorney, Agent, or Firm*—Shlesinger, Arkwright, Garvey & Dinsmore

[57] ABSTRACT

An automotive vehicle body and frame straightening apparatus including an endless track member of generally rectangular shape and having arcuate corners, the track member being of substantially round cross section and having at least one portion of reduced thickness so as to be engageable by both a force applying unit and anchoring unit at the portion of reduced thickness, each of the units being slidably positionable to any point of the track member to provide great flexibility in the locations at which the force applying unit and the anchoring unit may be attached to a vehicle.

12 Claims, 5 Drawing Figures

Fig. 2
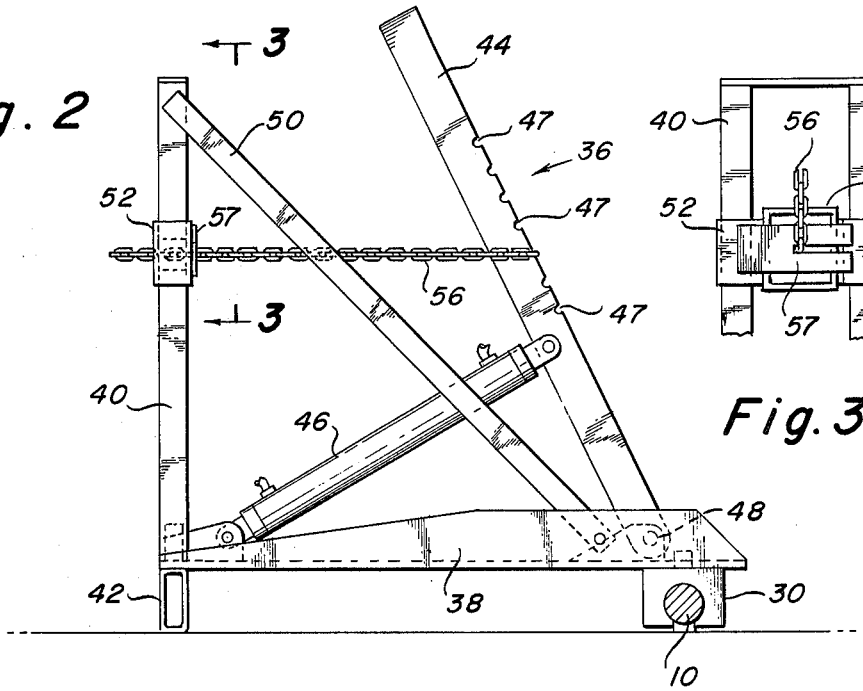
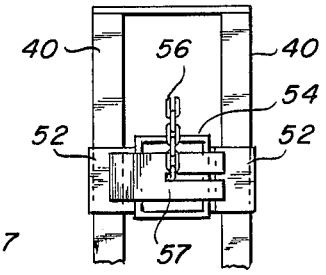
Fig. 3
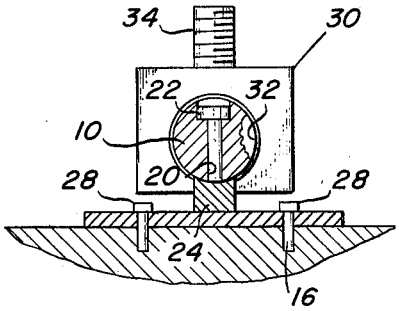
Fig. 4
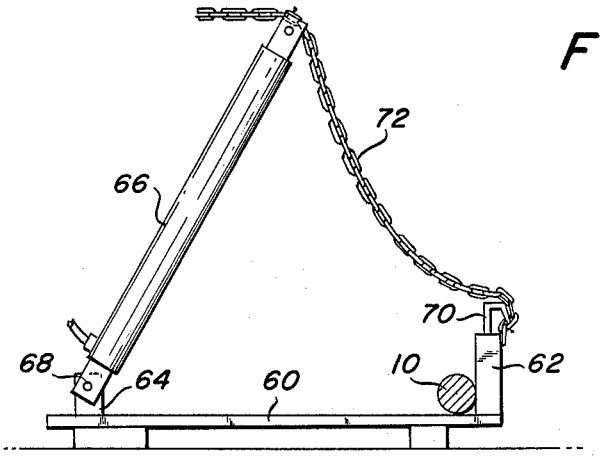
Fig. 5

AUTOMOTIVE VEHICLE BODY AND FRAME STRAIGHTENING APPARATUS

BACKGROUND AND OBJECTS

This invention relates to an apparatus for straightening automotive vehicle bodies and frames. More particularly, this invention relates to an automotive vehicle body and frame straightening apparatus of the type wherein the vehicle is anchored to a track, and is subjected to pulling operations by a force applying device which is also anchored to the track. A number of different types of vehicle frame and body straightening devices are known to the prior art, and the majority of these utilize some type of force applying apparatus such as hydraulic or pneumatic jacks, slide hammers and the like for straightening the frame and/or body of an automotive vehicle which has been damaged by collision.

More recently, a number of devices have become available which include a rail or track system for use with the pulling apparatus. In such devices, the vehicle being worked upon is anchored at one point on the track, and the force applying apparatus is attached to another, usually opposite, portion of the track. By making both the anchor and the force applying equipment attachable at various positions along the track, the restoration force applied to the vehicle can be applied at a number of different locations on the vehicle frame to more accurately control the restorative forces thereby insuring that the frame or body is bent back to its original configuration. Device of this type are typified by U.S. Pat. Nos. 3,754,427, 3,590,623, 3,623,353, 3,796,084, 3,425,575, 3,377,834 and 3,583,203.

Of these typical prior art devices, those described in U.S. Pat. Nos. 3,590,623, 3,623,353, and 3,754,427 are generally only suitable for use in a new installation, since the track system is of a type which must be embedded in the concrete floor thus, these systems would not be suitable for a retrofit installation into an existing body shop.

Furthermore, most of the prior art track systems utilize a rail or track wherein the force applying apparatus and the anchoring device may only be positioned at a restricted number of points along the track, and must be removed from the track, and then relocated and reattached to the track. The prior art systems typically utilize a track having squared off corners whereby the jacking apparatus and the anchoring apparatus may not be slid along the track around the corners. Since it is often one of the corners of the vehicle which is damaged, the ability to engage the force applying means all around the corner of the track is a significant advantage, particularly so when a vehicle has been damaged in this manner.

To overcome the disadvantages of the prior art body and frame straightening devices, the present invention provides a track formed of a round bar or pipe, the track being continuous in a generally rectangular shape and having arcuate corners of such a radius that the force applying apparatus and the anchoring devices may readily slide from one side of the track around one of the corners to adjacent side of the track without the necessity of removing the devices from the track. To permit installation of the force applying devices and the anchoring devices to the track, a portion of reduced thickness is provided at one or more appropriate locations on the track so that the track engaging element of the force applying device or the anchoring device may be slipped on to the track and then slid to the rounded portion of the track from which is it not removable. The simplicity of such a system is a significant advantage.

Further according to this invention, a number of force applying devices may be utilized with but a single source of hydraulic or pneumatic pressure in that the force applying units are provided with a locking apparatus so that once the hydraulic pressure is applied and the force is transmitted to the vehicle, the pulling force may be locked and the hydraulic pressure source released and then applied to an adjacent jack. Such a system materially reduces the installation and operation costs of the present invention.

Accordingly, it is a primary object of the present invention to overcome the disadvantages of prior art frame straightening devices.

Another object of this invention is to provide a frame straightening device wherein the force applying apparatus and the anchoring apparatus may be positioned at any point around the vehicle.

Still another object of this invention is to provide a frame straightening device which utilizes an endless track member of a generally rectangular shape with arcuate corners.

Still a further object of this invention is to provide a frame straightening device which may be installed in a retrofit manner to existing shops.

A still further object of this invention is to provide a vehicle body and frame straightening apparatus of simple yet extremely rigid construction.

Yet an another object of this invention is to provide a vehicle body and frame straightening apparatus wherein it is not necessary to continually apply hydraulic pressure to the jacking apparatus to maintain the jacking force.

Yet another object of this invention is to provide a vehicle body and frame straightening device which utilizes a track which may be anchored to a floor by an improved anchoring system.

These and other objects and advantages of the invention will become apparent when considered in light of the following description and claims when taken together with accompaying drawings in which:

FIG. 2 is a side elevational view of a jacking apparatus used with the present invention;

FIG. 3 is a view along lines 3—3 of the FIG. 2 and viewed in the direction of the arrows;

FIG. 4 is a sectional view along lines 4—4 of FIG. 1 showing in detailed the manner by which the track is anchored to the floor; and FIG. 5 is a view of a different type jacking apparatus which may be utilized with the present invention.

DESCRIPTION OF THE INVENTION

Figure 1:
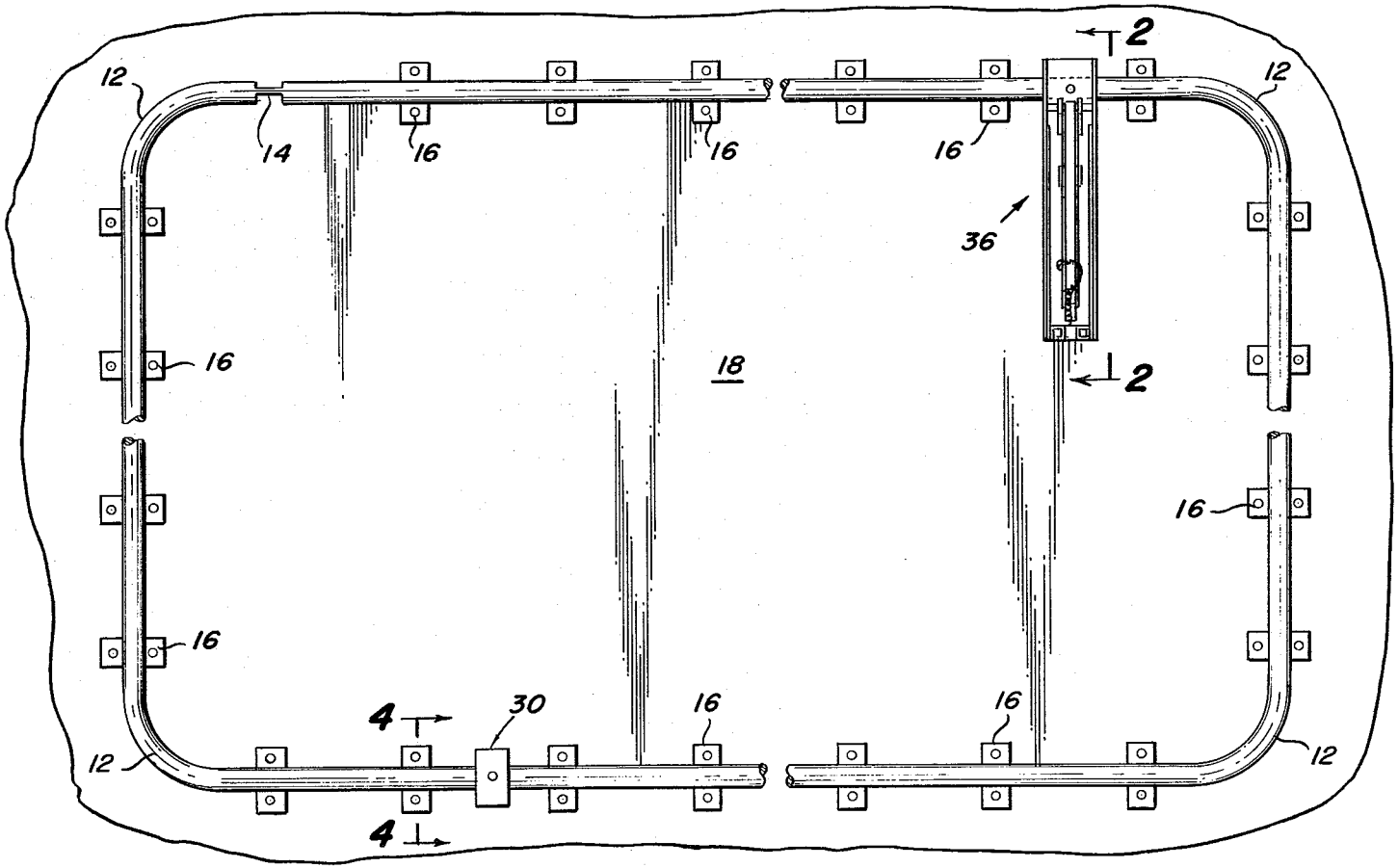
FIG. 1 is a top plan view of an installation of the frame straightening device of this invention.

Referring first to FIG. 1, a track member generally designated 10 is shown as having a generally rectangular configuration with rounded corners 12. The track member 10 has a portion of reduced thickness 14, preferably formed by cut-outs on opposite sides of the track member 10. The portion 14 may be located at any convenient place on the track member 10 or indeed there may be more than one such portion 14 located at different points on the track 10 for convenience.

The track 10 is provided with a series of anchor plates 16 spaced along the track for anchoring the track to a floor surface 18 in a manner to be described more fully hereinafter.

Referring to FIG. 4, the floor surface 18 which is typically concrete is seen to support the track 10 which is preferably formed from solid bar stock. At spaced points along the track 10, a counterbored hole 20 is provided through which a bolt 22 secures the track 10 through a spacer 24 to a plate 26. The plate 26 is in turn secured to the floor surface 18 by means of bolts 28 in a well-known manner.

The counterbored hole 20 and the bolt 22 are such a configuration that the head of the bolt does not extend above the top of the track 10. Of course the bolt 22 may be replaced by a stud extending upwardly from the plate 26 and secured by an appropriate nut.

As also seen in FIG. 4 a yoke member 30 engages the rail or track member 10, having been secured to the rail at the portion 14 of reduced thickness. The opening at the lower portion of the yoke 30 is just slightly larger than the thickness at the area 14 so that the yoke 30 may be placed on the track 10 at this portion, and may then be slid around the track to any desired position. The spacer 24 has a width or diameter dimension also less than the opening at the bottom of the yoke 30 so that the yoke will clear each of the spacer members as it is slid around the track 10. Additionally, the spacer elevates the track 10 slightly so that the yoke will not interfer with the bolts 28.

The channel 32 in the yoke 30 is of such a configuration that it engages the round track 10 through an arc of at least 270°, preferably about 300°, and thus be firmly secured on the track 10 and still being slidable around the track.

The yoke 30 is also provided with an upstanding stud 34 to which various tools or implements may be attached.

Thus in FIG. 4, a jack generally designated 36 is provided with a hole (not shown) so that the jack may slip down over the stud 34 and be secured to yoke 30 by means of a nut.

The jack 36 includes a frame having a base portion 38 and a pair of upstanding posts 40 secured to the frame 38. Also provided is a foot 42 of substantially the same height as the top of yoke 30 so as to maintain the base portion 38 in a substantially horizontal attitude, or parallel to the floor surface. Pivotally attached to one end of the base portion 38 is a lever arm 44 having a series of notches 47 therein. A suitable jack such as a hydraulic or pneumatic piston and cylinder 46 is provided and connects the lever arm 44 with the base 38 as shown. Arm 46 is pivotally mounted to the base 38 at 48. Also connected to each of the posts 40 are reinforcing struts 50 which serve to rigidify and strengthen the unit.

Mounted on the posts 40 is a slidable collar assemble 52 which may be positioned vertically along posts 40. The collar 52 includes a tubular channel portion 54 which connects the two sides of the collar assembly together. The tubular portion 54 is hollow so that a chain or other suitable flexible tensioning member 56 may pass therethrough. One end of the chain 56 is secured to the lever arm 44 in any suitable means, and the notches 47 serve to prevent the chain 56 from sliding on the lever arm 46. The other end of the chain 56 is connected to the vehicle frame at the point where the force is to be applied.

Because of the nature of the connection between the base 38 and the yoke 30, the base 38 may be swiveled to any desired angle about the stud 44.

In many operations, it is desirable to be able to maintain the pulling force on the vehicle frame through the chain, and yet be able to release the fluid pressure from the jack 46. To enable this to be done, a lock plate 57 is provided. This plate is provided with a slot 58, so that when it is desired to release the hydraulic pressure, the lock plate 57 is slipped into position around the chain 56, and the plate 57 bears on the collar assembly 52, the tubular portion 54, and thus on the posts 40. After the lock plate 57 is in position, the hydraulic pressure may be released and the force exerted on the vehicle body will remain.

In an alternate embodiment as shown in FIG. 5, the means by which the force application system is attached to the track member 10 is slightly different. Here, a base plate 60 is provided with an upstanding portion 62 at one end, and a suitable boss 64 at the other end. A force applying element such as hydraulic piston and cylinder arrangement 66 is pivotally attached to the boss 64 at 68. Post 62 carries on its upper end a suitable attaching device such as a hook 70 to which a chain 72 may be attached. The other end (not shown) of chain 72 is attached to the vehicle frame or body at the point where force application is to occur.

The base 60 is secured under the track 10 by initially advancing the device toward the track 10 in a position whereby the base 60 is substantially vertical whereby the post 62 passes under the track 10. Thereafter, the base 60 is returned to the horizontal position as shown in FIG. 5, and the posts 62 serves to secure the assembly from being pulled away from the track 10.

This arrangement is particularly useful when it is desired to apply a force having a vertical component to the frame.

The device of FIG. 5 could also be arranged with upstanding posts and a lock assembly in the manner similar to the embodiment of FIG. 3 if desired.

While this invention has been described as having a preferred design, it will be understood that it is capable of further modification. This application is, therefore, intended to cover any variations, uses, or adaptations of the invention following the general principles thereof and including such departures from the present disclosure has come within known or customary practice in the art to which this invention pertains, and as may be applied to the essential features hereinbefore set forth and fall within the scope of this invention or the limits of the appended claims.

What I claim is:

1. An automotive vehicle body and frame straightening apparatus comprising:

(a) an endless track member of generally rectangular shape and having arcuate corners, (b) said track member being of substantially round cross-section and having at least one portion of reduced thickness and being spaced from the floor surface, (c) means for anchoring said track member to a floor surface at a plurality of points along said track member, at least some of said anchoring means being positioned outside the periphery of said track member, (d) means for removably anchoring a vehicle to said track member, (e) force applying means pivotally adjustable about a vertical axis passing through said track member, (f) means removably anchoring said force applying means to said track member and comprising a yoke shaped member of a configuration such as to be attachable to and removable from said track member only at said reduced thickness portion, (g) each of said removable anchoring means including a channel passing therethrough and open on the bottom and adapted to engage the periphery of said track member through an arc of at least 270°, (h) each of said removable anchoring means and said force applying means being slidably positionable to any point along said track member without disengagement from said track member.

2. An apparatus as in claim 1 and wherein:

said reduced thickness portion is slightly longer than each of said removable anchoring means.

3. An apparatus as in claim 2 and wherein:

said reduced thickness portion comprises two substantially flat surfaces substantially normal to the floor surface.

4. An apparatus as in claim 2 and wherein:

said force applying means includes fluid pressure operated piston and cylinder means.

5. An apparatus as in claim 4 and wherein:

said force applying means further includes flexible force transmitting means for connecting said piston and cylinder means and a vehicle frame to be straightened.

6. An apparatus as in claim 5 and wherein:

(a) said track member anchoring means includes a plurality of counterbored bolt holes passing through said track member, (b) an anchoring member associated with each of said bolt holes and including a bolt passing through said bolt hole, and (c) said bolt being recessed in the counterbore of each of said bolt holes for securing said track member to said floor surface.

7. An apparatus as in claim 6 and wherein:

said anchoring member includes a plate attachable to a floor surface, said bolt being secured to said plate member.

8. An apparatus as in claim 5 and wherein:

(a) said force applying means further includes a frame, (b) means for locking the position of said flexible force transmitting means relative to said frame.

9. An apparatus as in claim 8 and including:

a plurality of said vehicle anchoring means.

10. An apparatus as in claim 9 and including:

a plurality of said force applying means.

11. An apparatus as in claim 8 and wherein:

(a) said frame includes a pair of spaced, substantially parallel upstanding frame elements, (b) said flexible force transmitting means passing between said frame elements, and (c) said locking means being removably engaged with each of said frame elements and said flexible force transmitting means.

12. An apparatus as in claim 11 and wherein:

said locking means comprises a slotted plate member adapted to slide over said flexible force transmitting member and engage said frame elements.

* * * * *